United States Patent [19]

Todd et al.

[11] Patent Number: 4,942,706

[45] Date of Patent: Jul. 24, 1990

[54] HOUSING STRUCTURE

[76] Inventors: Wayne A. Todd, 2213 Kirby Rd., Memphis, Tenn. 38119; Hunter D. Ryan, Jr., 283 Richards Way, Cordova, Tenn. 38018

[21] Appl. No.: 435,545

[22] Filed: Nov. 13, 1989

[51] Int. Cl.[5] ..... E04H 1/02

[52] U.S. Cl. ..... 52/234; 52/79.1; 52/169.3; 52/236.3; D25/17; D25/22

[58] Field of Search ..... 52/79.1, 79.2, 33, 169.3, 52/169.4, 234, 169.2, 236.3; 25/17, 22

[56] References Cited

U.S. PATENT DOCUMENTS

| | | | |
|---|---|---|---|
| 227,559 | 7/1973 | Edwards | D25/17 |
| 3,254,458 | 6/1966 | Van Der Lely | 52/79 |
| 3,417,526 | 12/1968 | Lawson | 52/169.3 |
| 3,732,649 | 5/1973 | Mehran | 52/169.3 |
| 3,852,924 | 12/1974 | Levenson | 52/79 |
| 3,874,137 | 4/1975 | Gentry | 52/169.3 X |
| 3,996,709 | 12/1976 | Coxe | 52/169.3 |
| 4,007,565 | 2/1977 | Finnegan | 52/169.3 |
| 4,222,207 | 9/1980 | Latimer | 52/169.3 |
| 4,232,490 | 11/1980 | Doane | 52/234 X |
| 4,345,408 | 8/1982 | Cote | 52/169.3 |
| 4,596,097 | 6/1986 | Stewart et al. | 52/236.3 |
| 4,718,205 | 1/1988 | Taylor | 52/234 X |
| 4,736,556 | 4/1988 | Scizak | 52/169.2 |
| 4,754,719 | 5/1988 | Blankstein et al. | 52/234 |
| 4,763,451 | 8/1988 | Butcher | 52/79.1 |
| 4,800,692 | 1/1989 | Jenn | 52/169.2 |

FOREIGN PATENT DOCUMENTS

| | | | |
|---|---|---|---|
| 494679 | 6/1919 | France | 52/234 |
| 970825 | 6/1950 | France | 52/234 |
| 360199 | 3/1962 | Switzerland | 52/234 |

*Primary Examiner*—Richard E. Chilcot, Jr.
*Assistant Examiner*—Deborah M. Ripley
*Attorney, Agent, or Firm*—Walker & McKenzie

[57] ABSTRACT

A building structure including a first unit having a front elevation, a rear elevation, a first side wall, and a second side wall; and a second unit having a front elevation, a rear elevation, a first side wall, and a second side wall; the first and second units being joined together with first side walls of the first and second units sharing a common border and with the front elevations of the first and second units facing opposite directions.

12 Claims, 2 Drawing Sheets

HOUSING STRUCTURE

BACKGROUND OF THE INVENTION

1. Field of the Invention:

The present invention relates, in general, to a two unit, single building housing structure.

2. Information Disclosure Statement:

Various duplex-type two unit, single building housing structures have been developed in the past. The typical prior art two unit, single building housing structure includes a front with an entrance for one of the units located on one side of the front of the building and an entrance for the other unit on the other side of the front of the building. A preliminary patentability search in class 52, subclasses 169.3, 169.4 and 234, and design class 25, subclass 4 produced the following patents: Van Der Lely, U.S. Pat. No. 3,254,458; Levenson, U.S. Pat. No. 3,852,924; Blankstein, et al., U.S. Pat. No. 4,745,719; and Butcher, U.S. Pat. No. 4,763,451. Van Der Lely discloses a multi-unit housing structure in which each unit is arranged in a staggered position with respect to the adjacent units and with the front of each unit facing the same direction as the front of each adjacent unit. Levenson discloses a multi-unit housing assembly in which the front entrances of adjacent units face the same direction. Blankstein et al. discloses a housing structure which can be converted between a single family home and a duplex unit with the entrance to one unit on the front of the structure and the entrance to the other unit on one side of the structure. Butcher discloses a modular duplex-type housing structure in which one unit may have a front entrance and the adjacent unit may be configured for a side entrance. None of the above patents or prior art disclose or suggest the present invention. More specifically, none of the above patents or prior art disclose or suggest a building structure including a first unit having a front elevation, a rear elevation, a first side wall, and a second side wall; and a second unit having a front elevation, a rear elevation, a first side wall, and a second side wall; the first and second units being joined together with first side walls of the first and second units sharing a common border and with the front elevations of the first and second units facing opposite directions.

SUMMARY OF THE INVENTION

The present invention is directed toward providing an improved two unit, single building housing structure. The concept of the present invention is to provide a two unit, single building housing structure which gives the appearance of a single unit when viewed from any elevation.

One objective of the present invention is to provide a double unit, single building housing structure which has no rear yard.

Another objective of the present invention is to provide a double unit, single building housing structure in which each unit fronts on a different street.

Another objective of the present invention is to provide a double unit, single building housing structure which looks like a large single family home when approached from either street.

Another objective of the present invention is to provide a double unit, single building housing structure in which each unit has a side yard patio.

Another objective of the present invention is to provide a double unit, single building housing structure in which each unit has a single or double car garage and additional parking for two cars.

The building structure of the present invention includes a first unit having a front elevation, a rear elevation, a first side wall, and a second side wall; and a second unit having a front elevation, a rear elevation, a first side wall, and a second side wall; the first and second units being joined together with first side walls of the first and second units sharing a common border and with the front elevations of the first and second units facing opposite directions.

DESCRIPTION OF THE PREFERRED EMBODIMENT

Figure 1:
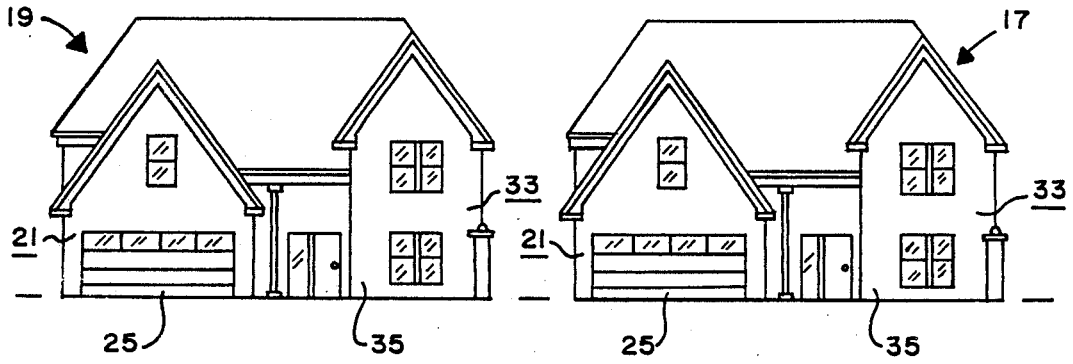
FIG. 1 is an elevational view of a pair of adjacent building structures of the present invention.
Figure 2:
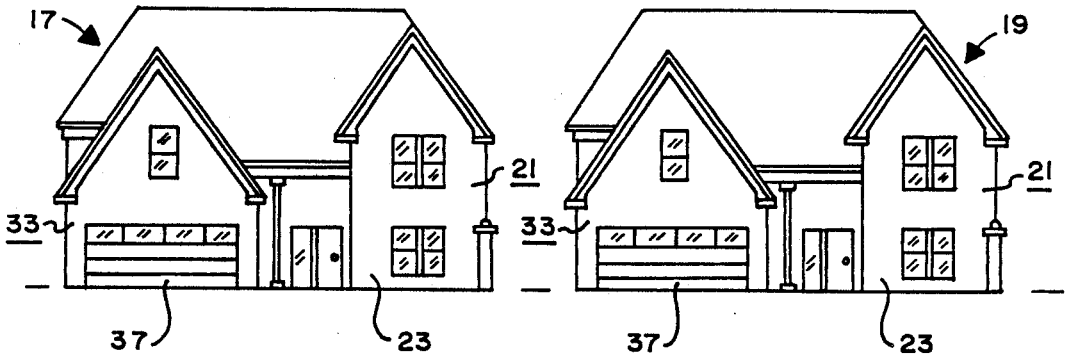
FIG. 2 is an elevational view of the pair of building structures of FIG. 1 shown from the opposite face of the building structures.
Figure 3:
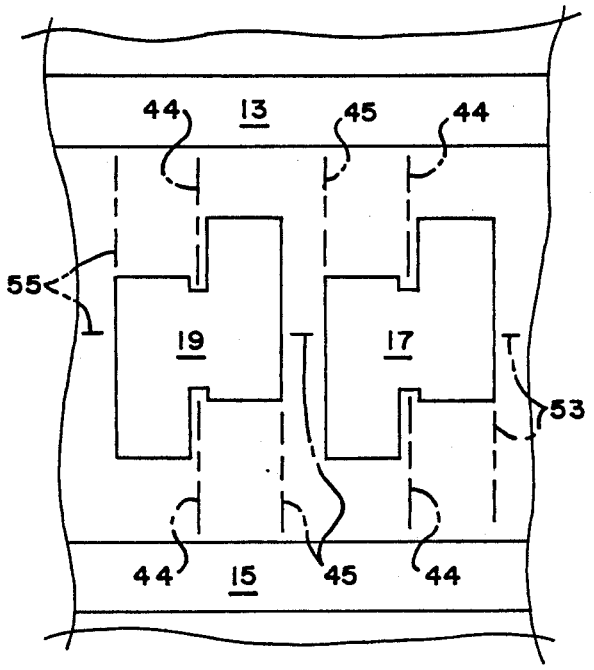
FIG. 3 is a somewhat diagrammatic plot plan showing the first and second building structures of FIGS. 1–4 positioned adjacent one another in a zero lot line subdivision.
Figure 4:
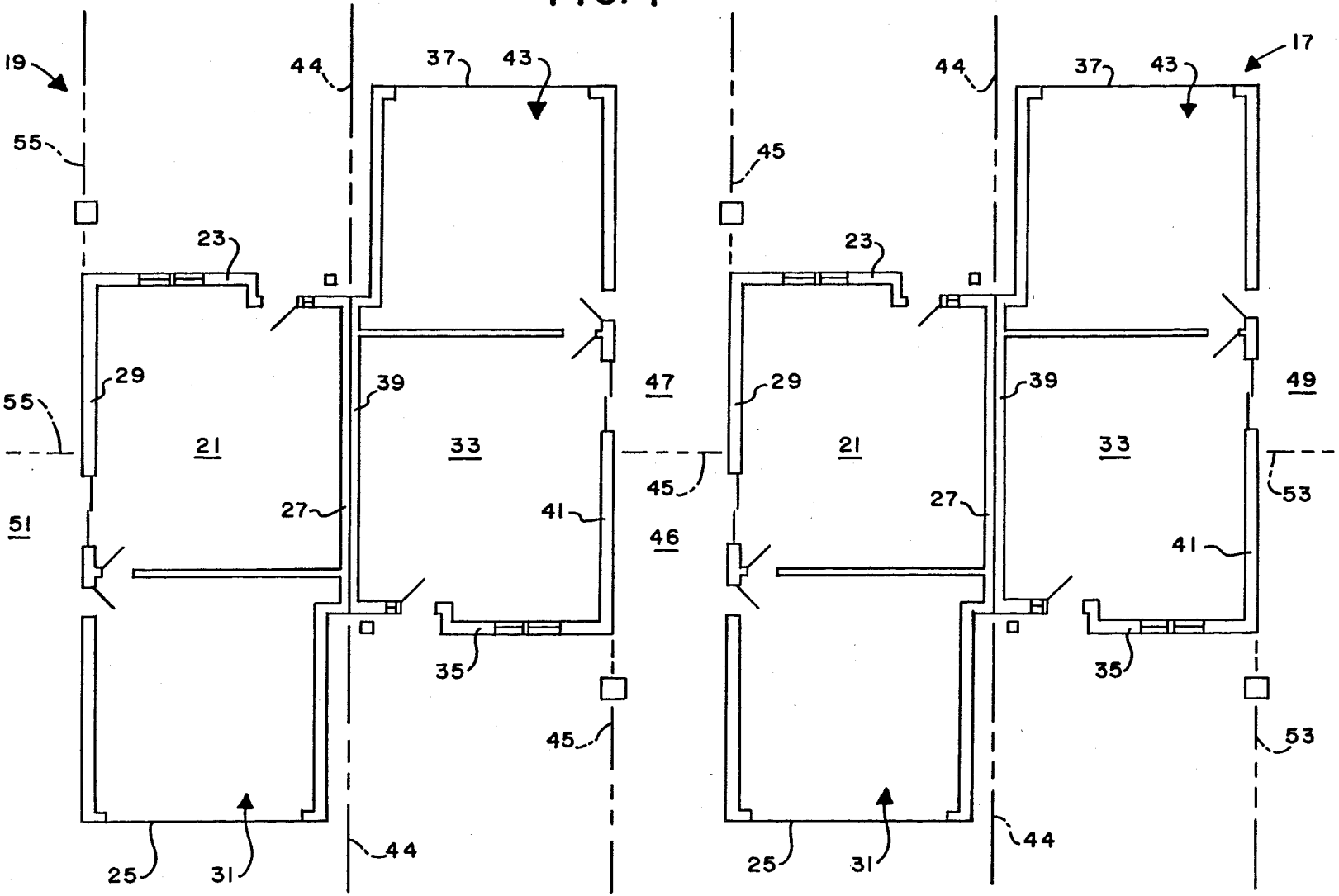
FIG. 4 is an enlarged, more detailed view of a portion of FIG. 3.

The preferred embodiment of the building structure of the present invention is especially designed for use in zero lot line subdivisions between first and second substantially parallel streets 13, 15 such as shown diagrammatically in FIG. 3. Preferably, the present invention includes at least a first building structure 17 and a second building structure 19 located adjacent one another, side by side in the zero lot line subdivision as shown in FIGS. 3 and 4.

Each building structure 17, 19 is substantially identical in basic features as herebelow described and the below detailed description of the first building structure 17 should suffice for both, with the same numerals used in the drawings to identify like features of each building structure 17, 19.

The building structure 17 includes a first unit 21 having a front elevation 23, a rear elevation 25, a first side wall 27, and a second side wall 29. The specific features, size and style of the first unit 21 may vary, depending on many factors. Thus, the first unit 21 may be a single or multi-story unit, may include one or more bedrooms, etc. The rear elevation 25 preferably opens into a single or double garage 31.

The building structure 17 includes a second unit 33 having a front elevation 35, a rear elevation 37, a first side wall 39, and a second side wall 41. The specific features, size and style of the second unit 33 may vary, depending on many factors. Thus, the second unit 33 may be a single or multi-story unit, may include one or more bedrooms, etc. The rear elevation 37 preferably opens into a single or double garage 43.

The first and second units 21, 33 are joined together with first side walls 27, 39 of the first and second units 21, 33 sharing a common border 44 and with the front elevations 23, 35 of the first and second units 21, 33 facing opposite directions. More specifically, the rear elevation 25 of the first unit 21 is preferably adjacent the front elevation 35 of the second unit 33 and the rear elevation 37 of the second unit 33 is preferably adjacent the front elevation 23 of the first unit 21.

The rear elevation 25 of the first unit 21 is preferably architecturally similar to the front elevation 35 of the second unit 33 for causing the building structure 17 to have the appearance of a single unit building structure when approached from the front elevation 35 of the second unit 33. Likewise, the rear elevation 37 of the second unit 33 is preferably architecturally similar to the front elevation 23 of the first unit 21 for causing the building structure 17 to have the appearance of a single unit building structure when approached from the front elevation 23 of the first unit 21.

With reference to FIGS. 3 and 4, the first unit 21 of the first building structure 17 and the second unit 33 of the second building structure 19 preferably share a common border 45. The first unit 21 of the first building structure 17 preferably includes a patio 46 between the second side wall 29 of the first unit 21 of the first building structure 17 and the second side wall 41 of the second unit 33 of the second building structure 19. Likewise, the second unit 33 of the second building structure 19 preferably includes a patio 47 between the second side wall 29 of the first unit 21 of the first building structure 17 and the second side wall 41 of the second unit 33 of the second building structure 19. The second unit 33 of the first building structure 17 preferably includes a patio 49 adjacent the second side wall 41 thereof and the first unit 21 of the second building structure 19 preferably includes a patio 51 adjacent the second side wall 29 thereof. It should be noted that similar building structures may be built adjacent the second side wall 41 of the second unit 33 of the first building structure 17 separated therefrom by a common border 53, and adjacent the second side wall 29 of the first unit 21 of the second building structure 19 separated therefrom by a common border 55. Fences (not shown) are preferably provided to enclose the patios 46, 47, 49, 51 as will now be apparent to those skilled in the art.

As thus constructed and used, the present invention provides building structure which can be used to develop a double front multi-unit zero lot line subdivision that is unique in that it has no rear yards. It has front and side yards only. Each building structure will have units that front on two different streets. The multi-unit building structures look like large single family homes when approached from either street. Each unit preferably has a fenced side yard patio, a single or double car garage plus space for two additional cars on the street for visitors.

Although the present invention has been described and illustrated with respect to a preferred embodiment and a preferred use therefor, it is not to be so limited since modifications and changes can be made therein which are within the full intended scope of the invention.

We claim:

1. A double unit building structure comprising:

a first unit having a front elevation, a rear elevation, a first side wall, and a second side wall; and a second unit having a front elevation, a rear elevation, a first side wall, and a second side wall;

said first and second units being joined together to form said double unit building structure with first side walls of said first and second units sharing a common border and with said front elevations of said first and second units facing opposite directions.

2. The building structure of claim 1 in which said rear elevation of said first unit is adjacent said front elevation of said second unit; and in which said rear elevation of said second unit is adjacent said front elevation of said first unit.

3. The building structure of claim 2 in which said rear elevation of said first unit is architecturally similar to said front elevation of said second unit for causing said building structure to have the appearance of a single unit building structure when approached from said front elevation of said second unit; and in which said rear elevation of said second unit is architecturally similar to said front elevation of said first unit for causing said building structure to have the appearance of a single unit building structure when approached from said front elevation of said first unit.

4. A zero lot line subdivision including at least a first double unit building structure and a second double unit building structure located between substantially parallel first and second streets; each of said double unit building structures comprising:

a first unit having a front elevation, a rear elevation, a first side wall, and a second side wall; and a second unit having a front elevation, a rear elevation, a first side wall, and a second side wall;

said first and second units being joined together to form said double unit building structure with first side walls of said first and second units sharing a common border and with said front elevations of said first and second units facing opposite directions.

5. The zero lot line subdivision of claim 4 in which said first unit of said first building structure and said second unit of said second building structure share a common border.

6. The zero lot line subdivision of claim 5 in which said first unit of said first building structure includes a patio between said second side wall of said first unit of said first building structure and said second side wall of said second unit of said second building structure.

7. The zero lot line subdivision of claim 6 in which said second unit of said second building structure includes a patio between said second side wall of said first unit of said first building structure and said second side wall of said second unit of said second building structure.

8. The building structure of claim 4 in which said rear elevation of said first unit of said first building structure is adjacent said front elevation of said second unit of said first building structure; and in which said rear elevation of said second unit of said first building structure is adjacent said front elevation of said first unit of said first building structure.

9. The building structure of claim 8 in which said rear elevation of said first unit of said second building structure is adjacent said front elevation of said second unit of said second building structure; and in which said rear elevation of said second unit of said second building structure is adjacent said front elevation of said first unit of said second building structure.

10. The building structure of claim 9 in which said rear elevation of said first unit of said first building unit is architecturally similar to said front elevation of said second unit of said first building structure for causing said first building structure to have the appearance of a single unit building structure when approached from said front elevation of said second unit of said first building structure; and in which said rear elevation of said second unit of said first building structure is architecturally similar to said front elevation of said first unit of said first building structure for causing said first building structure to have the appearance of a single unit building structure when approached from said front elevation of said first unit of said first building structure.

11. The building structure of claim 10 in which said rear elevation of said first unit of said second building unit is architecturally similar to said front elevation of said second unit of said second building structure for causing said second building structure to have the appearance of a single unit building structure when approached from said front elevation of said second unit of said second building structure; and in which said rear elevation of said second unit of said second building structure is architecturally similar to said front elevation of said first unit of said second building structure for causing said second building structure to have the appearance of a single unit building structure when approached from said front elevation of said first unit of said second building structure.

12. A zero lot line subdivision including at least a first double unit building structure and a second double unit building structure located between substantially parallel first and second streets;

said first double unit building structure consisting of a first unit having a front elevation, a rear elevation, a first side wall, and a second side wall; and a second unit having a front elevation, a rear elevation, a first side wall, and a second side wall;

said first and second units of said first double unit building structure being joined together with first side walls of said first and second units of said first double unit building structure sharing a common border and with said front elevations of said first and second units of said first double unit building structure facing opposite directions;

said second double unit building structure consisting of a first unit having a front elevation, a rear elevation, a first side wall, and a second side wall; and a second unit having a front elevation, a rear elevation, a first side wall, and a second side wall;

said first and second units of said second double unit building structure being joined together with first side walls of said first and second units of said second double unit building structure sharing a common border and with said front elevations of said first and second units of said second double unit building structure facing opposite directions;

said first unit of said first double unit building structure including a patio between said second side wall of said first unit of said first double unit building structure and said second side wall of said second unit of said second building structure;

said second unit of said second double unit building structure including a patio between said second side wall of said first unit of said first double unit building structure and said second side wall of said second unit of said second double unit building structure.

* * * * *